United States Patent [19]

Sletten, II

[11] Patent Number: 4,709,442

[45] Date of Patent: Dec. 1, 1987

[54] PORTABLE EXTRACTOR

[75] Inventor: William C. Sletten, II, Eden Prairie, Minn.

[73] Assignee: Advance Machine Company, Plymouth, Minn.

[21] Appl. No.: 921,629

[22] Filed: Oct. 21, 1986

[51] Int. Cl.[4] ..... A47L 11/30

[52] U.S. Cl. ..... 15/320; 15/321; 15/354; 15/361

[58] Field of Search ..... 15/320, 321, 354, 361

[56] References Cited

U.S. PATENT DOCUMENTS

| | | | |
|---|---|---|---|
| 1,199,443 | 9/1916 | Van Der Putten . | |
| 2,055,734 | 9/1936 | Sparklin . | |
| 3,220,043 | 11/1965 | Lampe | 15/354 X |
| 3,624,861 | 12/1971 | Freiheit | 15/320 |
| 3,675,268 | 7/1972 | Nordeen | 15/350 |
| 3,676,892 | 7/1972 | Nordeen | 15/359 |
| 3,813,725 | 6/1974 | Rinker | 15/347 |
| 3,827,103 | 8/1974 | Nordeen et al. | 15/359 |
| 3,902,219 | 9/1975 | Jones | 15/321 X |
| 4,139,922 | 2/1979 | Fitch | 15/321 |
| 4,146,944 | 4/1979 | Pinto | 15/321 |
| 4,156,952 | 6/1979 | Lynch | 15/320 |
| 4,167,799 | 9/1979 | Webb | 15/320 |
| 4,446,594 | 5/1984 | Watanabe et al. | 15/326 |

*Primary Examiner*—Chris K. Moore

*Attorney, Agent, or Firm*—Peterson, Wicks, Nemer & Kamrath

[57] ABSTRACT

A portable extractor according to the teachings of the present invention is taught including a tool assembly pivotally mounted on a main body assembly. The portable extractor is supported on the floor by a set of wheels on the tool assembly and by a set of wheels on the main body assembly. The tool assembly applies a cleaning solution to the floor, with the cleaning solution being drawn from a supply tank of the main body assembly. The tool assembly also extracts the cleaning solution from the floor, with the extracted cleaning solution being deposited in a storage tank of the main body assembly. In a preferred form for cleaning carpeted floors, the tool assembly further includes a powered rotary brush for agitating the carpet. In operation, the tool assembly pivots with respect to the main body assembly between working and transport modes automatically when the portable extractor is pulled or pushed on the floor. In the working mode, the tool assembly is located such that the cleaning process members engage the floor and in the transport mode, the tool assembly is carried by its wheels and the cleaning process members are spaced from the floor. In the most preferred form, the supply tank is in a novel saddle type arrangement on the storage tank to maintain substantially uniform weight distribution on the wheels of the tool assembly when the levels in the tanks change.

30 Claims, 5 Drawing Figures

PORTABLE EXTRACTOR

BACKGROUND

The present invention generally relates to apparatus for cleaning floors, particularly to apparatus for cleaning floors which applies cleaning solutions to the floor and then extracts the soiled cleaning solutions from the floor, and specifically to portable extractors.

The operation of floor cleaning and the like is often accomplished by pulling the cleaning apparatus a short distance over the floor with the cleaning apparatus in a cleaning mode and then repeating this operation over the same area until the desired degree of cleanliness is obtained. The repetition of a cleaning and transport mode is often accomplished by the operator tilting the cleaning apparatus and pushing and pulling the cleaning apparatus over the entire floor surface. In cleaning operations where a liquid cleaning solution is applied to the floors and then extracted from the floor, such cleaning solution may be stored in the cleaning apparatus increasing the effort required in tilting the cleaning apparatus and operation of such cleaning apparatus was very tiresome for long time periods. Thus a need has arisen for cleaning apparatus which applies and extracts cleaning solution from the area desired to be cleaned which requires less effort to operate and automatically places the cleaning structure in working and transport modes of operation by simply pushing or pulling on the cleaning apparatus.

SUMMARY

The present invention solves these and other needs and problems in cleaning operations by providing, in preferred forms, a portable extractor including a tool assembly pivotally mounted with respect to a main body assembly. The tool assembly includes a member located adjacent the front end of the tool assembly for extracting the soiled cleaning solution from the floor and a cleaning solution applicator located intermediate the rear end of the tool assembly and the cleaning solution extracting member. The tool assembly further includes members such as wheels for providing mobility of the tool assembly upon the floor located intermediate the rear end of the tool assembly and the cleaning solution extracting member. The main body assembly includes apparatus for drawing cleaning solution from a supply tank and supplying the cleaning solution to the cleaning solution applicator of the tool assembly and for vacuuming extracted cleaning solution from the cleaning solution extracting member of the tool assembly and depositing the extracted cleaning solution into a storage tank. The main body assembly further includes members such as wheels for providing mobility of the body assembly upon the floor. In operation, the tool assembly pivots about the mobility providing members of the tool assembly such that the cleaning solution extracting member is spaced from the floor when the tool and body assemblies are advanced along the floor and the tool assembly pivots about the tool assembly mobility providing members such that the cleaning solution extracting member engages the floor when the tool and body assemblies are retracted along the floor.

It is thus an object of the present invention to provide a novel cleaning apparatus.

It is further an object of the present invention to provide such a novel cleaning apparatus where a cleaning solution is applied and extracted from a cleaning surface.

It is further an object of the present invention to provide such a novel cleaning apparatus which automatically places the cleaning structure in working and transport modes of operation by simply pushing or pulling on the cleaning apparatus.

It is further an object of the present invention to provide such a novel cleaning apparatus which requires less effort to operate.

It is further an object of the present invention to provide such a novel cleaning apparatus which may be operated for long periods of time.

It is further an object of the present invention to provide such a novel cleaning apparatus which is not required to be tilted during operation.

It is further an object of the present invention to provide such a novel cleaning apparatus which allows smooth, one handed operation.

It is further an object of the present invention to provide such a novel cleaning apparatus which regulates the cleaning pressure on the cleaning surface.

It is further an object of the present invention to provide such a novel cleaning apparatus having automatically maintained cleaning pressure.

It is further an object of the present invention to provide such a novel cleaning apparatus which maintains substantially uniform weight distribution as the cleaning solution levels vary in the storage and supply tanks.

It is further an object of the present invention to provide such a novel cleaning apparatus allowing factory and/or operator interchange of tool assemblies.

It is further an object of the present invention to provide such a novel cleaning apparatus which biases the tool assembly with respect to the body assembly for biasing the tool assembly into its working mode of operation.

It is further an object of the present invention to provide such a novel cleaning apparatus which may include other cleaning processes such as agitation.

These and further objects and advantages of the present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
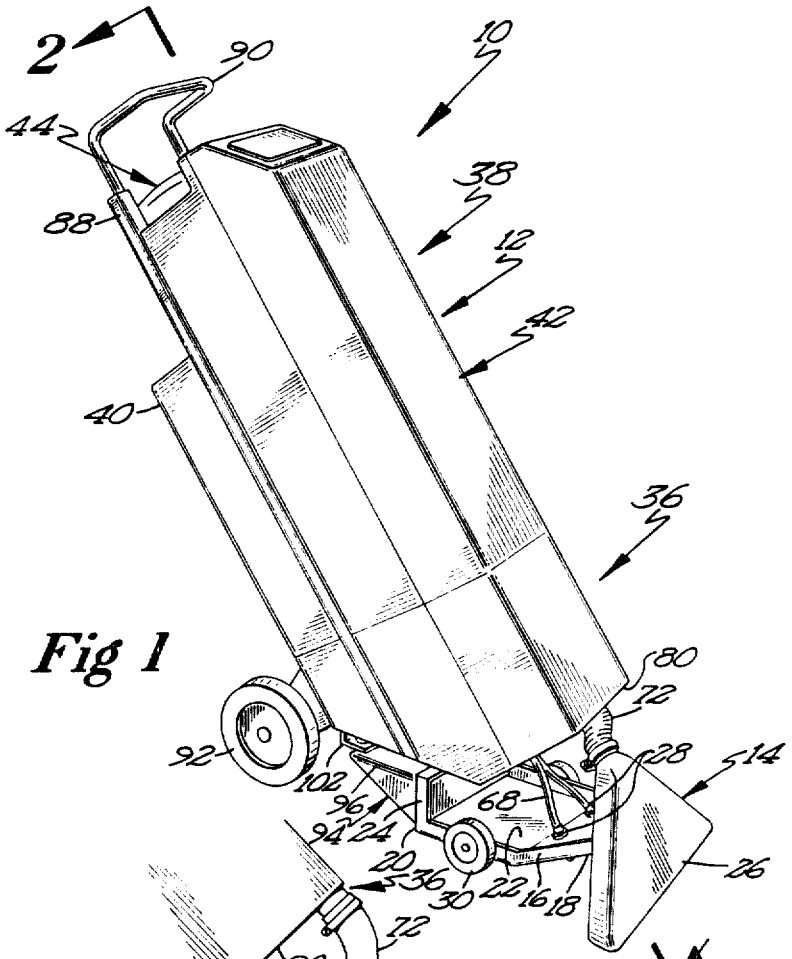
FIG. 1 shows a right side perspective view of a first preferred form of a portable extractor according to the teachings of the present invention.

All figures are drawn for ease of explanation of the basic teachings of the present invention only; the extensions of the Figures with respect to number, position, relationship, and dimensions of the parts to form preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "front", "rear", "top", "bottom", "upper", "lower", "first", "second", "inside", "outside", "advanced", "retracted", "pushed", "pulled" and similar terms are used herein, it should be understood that these terms have reference only to the structure shown in the drawings as it would appear to a person viewing the drawings and are utilized only to facilitate describing the invention.

DESCRIPTION

A portable extractor according to the teachings of the present invention is shown in the drawings and is generally designated 10. Extractor 10 generally includes a main body assembly 12 and a tool assembly 14. According to the teachings of the present invention, tool assembly 14 generally includes a chassis 16 having a front end 18 and a rear end 20 and particularly is of an L-configuration including a platform 22 extending generally along the floor and an upstanding rear wall 24 extending generally perpendicular therefrom. Adjacent to front end 18, tool assembly 14 further includes a pick-up member 26 such as an extraction vacuum shoe or a hard floor squeegee tool for extracting soiled cleaning solution from the floor. A cleaning solution applicator 28 such as nozzles is provided on chassis 16 intermediate rear end 20 and pick-up member 26 for applying cleaning solution to the floor. Wheels 30 are provided on platform 22 spaced from rear end 20 for providing mobility of tool assembly 14 upon the floor and in the most preferred form are located intermediate rear end 20 and applicator 28. In a preferred form of the present invention, tool assembly 14 includes a rotary brush 32 mounted to platform 22 and intermediate pick-up member 26 and applicator 28 for agitating carpeted floor for removing dirt therefrom and is mounted to engage the floor simultaneously with pick-up member 26. Rotary brush 32 may be rotated by any suitable means such as by motor 33 as shown. In its most preferred form, tool assembly 14 may include a shroud 34 to aesthetically cover tool assembly 14 and its components.

Figure 5:
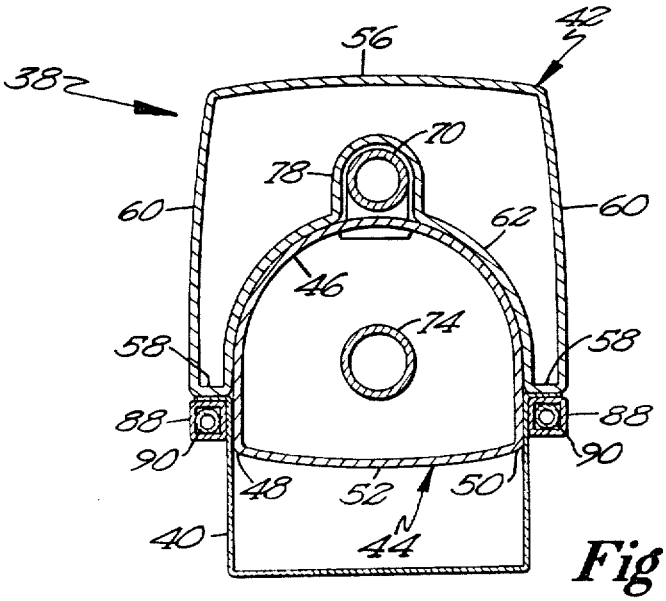
FIG. 5 shows a cross sectional view of the portable extractor of FIGS. 1 and 2 according to section line 5—5 of FIG. 2.

According to the preferred teachings of the present invention, main body assembly 12 generally includes a mechanical portion 36, a tank portion 38, and a storage compartment 40. Tank portion 38 includes a cleaning solution supply tank 42 and an extracted cleaning solution storage tank 44, with supply tank 42 straddling storage tank 44 for purposes to be set forth hereinafter. As best seen in FIG. 5, tank 44 is generally cylindrical in configuration and specifically includes a first wall section 46 having a generally semicircular cross-section and including first and second free edges 48 and 50 and includes a second, generally straight wall section 52 extending between edges 48 and 50 and defining an interior, with wall section 52 being slightly arcuate away from the interior of tank 44. A spigot 54 for draining tank 44 is provided adjacent to the bottom thereof.

In its most preferred form, tank 42 is generally saddle shaped for straddling wall section 46 of storage tank 44 and particularly has a generally rectangular configuration including first and second side walls 56 and 58 and first and second end walls 60. Side wall 58 includes a recessed portion 62 located intermediate end walls 60 and having a shape and size complementary to and for receipt on wall section 46 of tank 44. In its most preferred form, side wall 58 has a width greater than the width of wall section 52 and is spaced from edges 48 and 50 of wall section 46 of tank 44.

Mechanical portion 36 of main body assembly 12 includes provisions for drawing cleaning solution from supply tank 42 and supplying it to applicator 28 of tool assembly 14 shown in the most preferred form as a pump 64 in fluid communication by conduit 66 to tank 42 and in fluid communication by conduit 68 to applicator 28. Additionally, provisions for vacuuming extracted cleaning solution from pick-up member 26 and depositing it in storage tank 44 is included. In particular, the vacuuming and depositing provisions are shown in the most preferred form as a conduit 70 in fluid communication with the top of tank 44 and in fluid communication with pick-up member 26 such as by flexible hose 72. Additionally, a standing draw pipe 74 is located in tank 44 in air communication with a fan 76 for purposes of placing the interior of tank 44 under a vacuum. The outlet of fan 76 can be vented in a suitable manner in mechanical portion 36. In its most preferred form, recessed portion 62 of tank 42 includes a further recessed portion 78 of a size and shape complementary to and for receipt of conduit 70.

In the most preferred form, tanks 42 and 44 have an angular orientation with respect to the floor and in particular have an angular orientation of approximately 45 degrees from the floor. In the most preferred form, the bottom end 80 of mechanical portion 36 includes a first end portion 82 disposed generally parallel to the floor and a second end portion 84 extending generally perpendicular to the axis of tanks 42 and 44 and at an angle of 140 degrees to first end portion 82.

According to the teachings of the present invention, the free, top end of wall 24 of rear end 20 of tool assembly 14 is pivotally mounted to end portion 82 of bottom end 80 of main body assembly 12 by hinge member 86 about an axis generally parallel to and spaced from the axis of wheels 30. Main body assembly 12 further includes tubular frame members 88 which extend from the top of tanks 42 and 44 and adjacent to tank 44 beneath side walls 58 of tank 42, as best seen in FIG. 5, and terminate on bottom portion 82 adjacent to hinge members 86. A handle 90 may be provided for main body assembly 12 such as a generally U-shaped member having its legs including a right angular bend and extending into frame members 88. Suitable controls such as a trigger type switch can be provided in conjunction with handle 90 for stopping or starting the operation of motor 33 and fan 76 and/or pump 64. Storage compartment 40 may be secured to frame members 88 and is provided to store the electric supply cord for pump 64 and for fan 76 and any cleaning supplies and materials as desired. Wheels 92 are further included in the most preferred form secured to mechanical portion 36 of main body assembly 12 for providing mobility of main body assembly 12 upon the floor. The axis of wheels 92 is generally parallel to and spaced from the axes of wheels 30 and hinge member 86 and is located generally slightly behind the bottom end of tanks 42 and 44.

Figure 4:
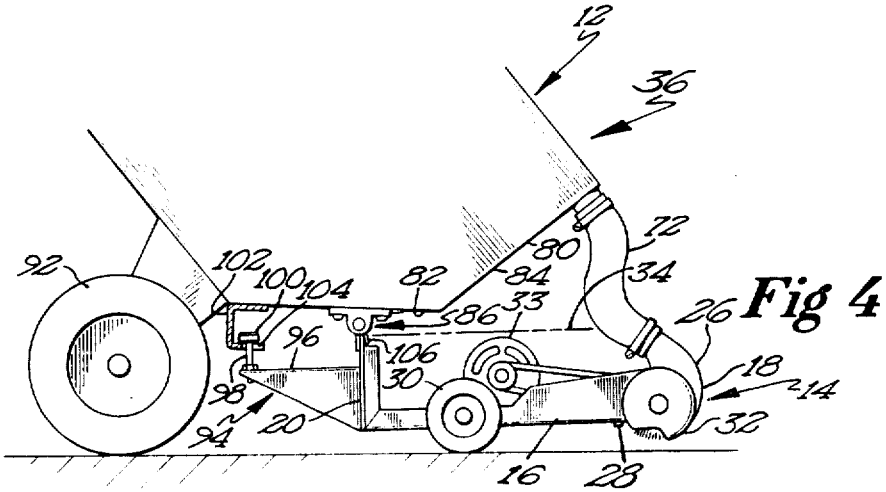
Figure 2:
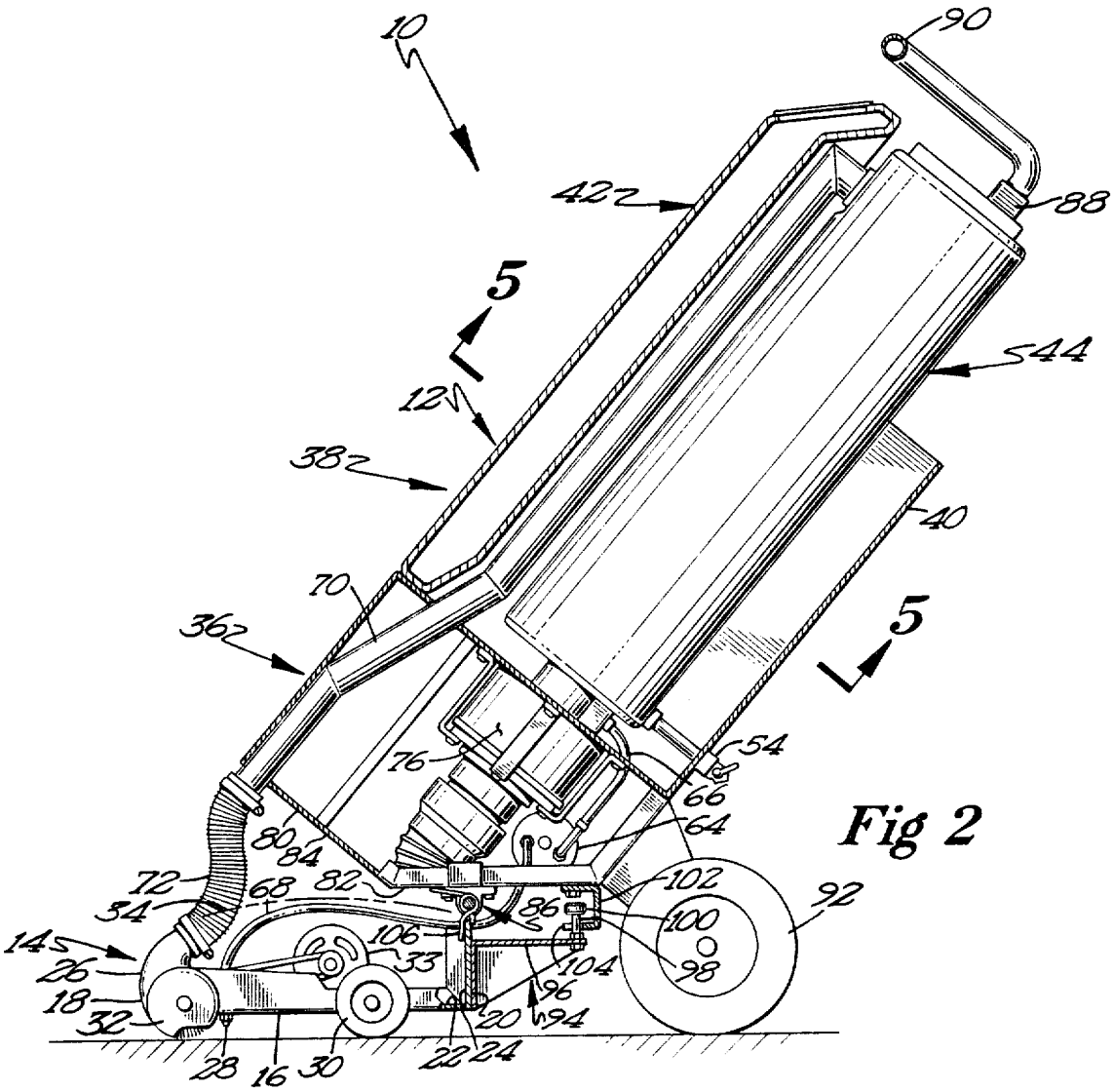
FIG. 2 shows a cross sectional view of the portable extractor of FIG. 1 according to section, line 2—2 of FIG. 1 including a tool assembly of a second preferred form.

Extractor 10 rests on wheels 30 and 92. The axis of hinge members 86 is located intermediate the axes of wheels 30 and 92 and is arranged such that the weight of extractor 10 and the cleaning solution within tanks 42 and 44 is distributed between main body assembly 12 and tool assembly 14 and so that tool assembly 14 pivots about wheels 30 such that pick-up member 26 is spaced from the floor when extractor 10 is pushed or advanced along the floor as best seen in FIG. 4 and so that tool assembly 14 pivots about wheels 30 such that pick-up member 26 engages the floor when extractor 10 is pulled or retracted along the floor as best seen in FIG. 2.

Figure 3:
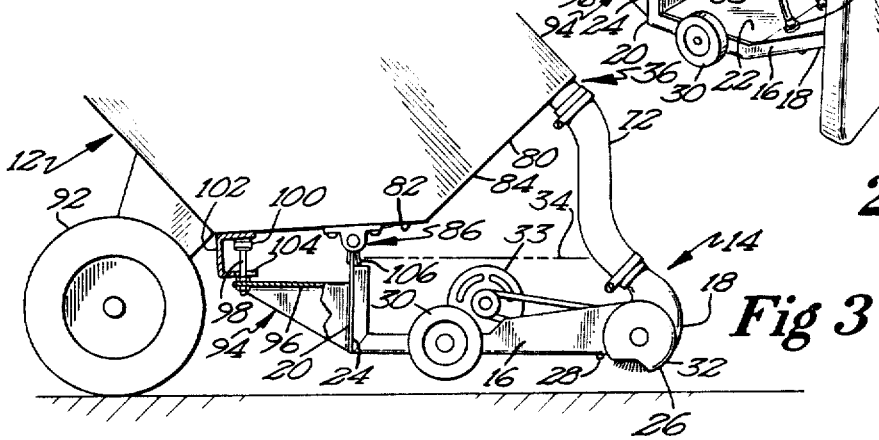
FIGS. 3 and 4 show partial side views of the portable extractor of FIG. 2 in different orientations.

To prevent the bottom corner of platform 22 and wall 24 of rear end 20 of tool assembly 14 from engaging the floor when tool assembly 14 pivots about wheels 30 spacing pick-up member 26 from the floor, member 94 for limiting the pivotal movement of tool assembly 14 with respect to main body assembly 12 is provided according to the teachings of the present invention. Specifically, an abutment wall 96 is provided in the most preferred form extending generally perpendicular from wall 24. Abutment wall 96 may include suitable bracing members as shown. A bolt 98 having an enlarged head 100 is threadably received in the end of wall 96 and upstands therefrom generally perpendicular to the floor. A stop member 102 is further provided having a generally U-shape in its most preferred form and including a first leg secured to end portion 82 and a second leg spaced therefrom. An aperture 104 is further provided in the second leg of stop member 102 having a shape allowing the shank of bolt 98 to reciprocate therein but preventing enlarged head 100 from passing therethrough. Thus, as best seen in FIG. 4, tool assembly 14 will pivot about wheels 30 when extractor 10 is advanced along the floor only until head 100 engages the second leg of stop member 102 which then prevents further pivoting and preventing the rear corner of tool assembly 14 from touching the floor and limiting the spacing of the cleaning solution pick-up member 26 from the floor. In its most preferred form, the second leg of stop member 102 abuts with abutment wall 96 for preventing further pivoting of tool assembly 14 with respect to main body assembly 12 when extractor 10 is tilted about wheels 92 such that tool assembly 14 is raised off the floor and thus limiting the spacing of pick-up member 26 from main body assembly 12 as best seen in FIG. 3.

Now that the construction and basic operation of portable extractor 10 according to the preferred form of the teachings of the present invention have been set forth, the advantages, the subtle features, and the selection of the various parameters for the optimized extractor 10 according to the teachings of the present invention can be set forth and appreciated. Portable extractors have generally two modes of operation: a working mode and a transport mode. In the working mode, a cleaning solution is applied to the floor and a pick-up member is dragged on the floor to remove or extract the applied cleaning solution from the floor. In addition, additional cleaning processes may be provided such as agitating the floor in the case of a floor covered with carpeting. In the transport mode, the extractor is moved to the next position, with the pickup member and any other cleaning members such as brushes not engaging the floor. During the normal operation of a portable extractor, the two modes of operation are used frequently with the operator pulling the extractor in its working mode backwards a short distance such as two feet (two-thirds of a meter) on the floor being cleaned and then quickly transporting the extractor forward in its transport mode to clean the same spot of the floor again or move over to another like area to clean.

Prior to the present invention, prior extractors required that the extractor be physically tipped backwards about its transport wheels to space the pick-up member from the floor and then to push the extractor forward. At that time, the operator would then physically tip the extractor forward such that the pick-up member engages the floor and utilize the extractor in its work mode. As the machine includes 5 to 6 gallons (19 to 23 liters) of cleaning solution in its storage and supply tanks, the effort required to physically tip prior extractors including cleaning solution is great and operation especially for long time periods can be very tiresome.

Portable extractor 10 according to the teachings of the present invention accomplishes both the working and transport mode of operation without tilting extractor 10. Specifically, tool assembly 14 automatically pivots about wheels 30 into its working mode of operation when the operator pulls extractor 10 backwards toward himself. Specifically, tool assembly 14 automatically pivots about wheels 30 such that pick-up member 26 and any other cleaning members such as rotary brush 32 engage the floor as shown in FIG. 2 when extractor 10 is pulled backwards on the floor. Likewise, after extractor 10 according to the teachings of the present invention has been pulled towards the operator the desired cleaning distance, tool assembly 14 automatically pivots about wheels 30 into its transport mode of operation when the operator pushes extractor away from himself. Specifically, tool assembly 14 automatically pivots about wheels 30 such that pick-up member 26 and any other cleaning members such as rotary brush 32 are spaced from and do not engage the floor as shown in FIG. 4 when extractor 10 is pushed forward on the floor. Therefore, it should be noted that portable extractor 10 is not in any way tipped by the operator and in fact allows smooth, one handed operation with minimal effort according to the teachings of the present invention.

Further, it should be noted that due to the requirement of tipping prior extractors, the tanks of the cleaning solution were positioned such that the center of gravity was moved backwards to result in a counterbalancing to assist the operator in tipping the extractors. However, such shift in the center of gravity also resulted in less pressure of the pick-up member on the floor affecting their operation and efficiency. To counteract this reduction of pick-up member efficiency, it was often necessary for the operator to tilt prior extractors forward taking some weight off the transport wheels and placing additional mass on the pick-up member. This further operation requires additional effort for the operator and is further tiresome, especially over long periods of time.

It can then be appreciated that since the weight of extractor 10 and cleaning solution in tanks 42 and 44 is carried by two sets of wheels 30 and 92 and it is not necessary to tilt extractor 10 in operation, it is possible to position the center of gravity forwards of its placement in prior extractors. It should then be further noted that the pressure placed on the floor by pick-up member 26 depends upon the weight distribution of portable extractor 10 and thus upon the location of wheels 92, hinge member 86, wheels 30, and the particular tool assembly construction. As an example, the weight of motor 33 and rotary brush 32 acts as dead weight in pivoting pick-up member 26 downward about the axis of wheels 30. However, it may be desired to utilize identical main body assembly 12 with different types and constructions of tool assemblies 14 allowing the operator to accomplish different cleaning tasks utilizing the same main body assembly 12 and substituting different tool assemblies 14 according to the cleaning task desired and/or allowing standard manufacturing and inventory for different types of portable extractors 10 according to the teachings of the present invention. Such different types and constructions of tool assemblies 14 may have different tendencies to pivot pick-up member 26 downward about the axis of wheels 30. For example, as best seen in FIG. 1, tool assembly 14 is of the type for utilization on hard floors and specifically does not include rotary brush 32 and motor 33 typically utilized on carpeted floors. Thus, tool assembly 14 of FIG. 1 has less dead weight and has less of a tendency to pivot pick-up member 26 downwardly about wheels 30. In addition to the possibility of changing the spacing of wheels 30 and hinge member 86 from each other and from wheels 92, one method of obtaining sufficient cleaning pressure while utilizing standard extractor construction would be adding weights to tool assembly 14 to achieve the desired cleaning pressure. A further, preferred method of achieving the desired cleaning pressure would be to utilize a biasing member 106 such as torsion springs as shown for biasing tool assembly 14 with respect to main body assembly 12 about the axis of hinge members 86 for biasing tool assembly 14 into its working mode of operation with pick-up member 26 downwardly about the axis of wheels 30. The size of torsion springs 106 may be varied for the particular type and construction of tool assembly 14 utilized to vary the downward force created by torsion springs 106. By utilizing torsion springs 106 according to the teachings of the present invention, the overall weight of portable extractor 10 is reduced, thus decreasing shipping costs and the effort required by the operator in pushing and pulling portable extractor 10 on the floor according to the teachings of the present invention. It can then be noted that the desired cleaning pressure can be achieved by utilizing any one or a combination of the aforementioned or other methods.

It should be noted that due to the pivotal nature of tool assembly 14 with respect to main body assembly 12, even if the operator would tilt main body assembly 12 forward, pressure upon pick-up member 26 would not significantly increase until wheels 92 were completely removed from the floor. This prevents the operator from attempting to place excess pressure upon tool assembly 14 by tilting extractor 10 forward and insures that cleaning pressure of tool assembly 14 is not variable but is maintained automatically and not dependent on operator involvement. This is also of importance to control the amperage draw of motor 33 and any other powered cleaning processes located in tool assembly 14.

It should be further appreciated that the particular construction of main body assembly 12 according to the teachings of the present invention is believed to be particularly advantageous. Particularly, the construction of supply tank 42 straddling storage tank 44 in a saddle like manner and with frame members 88 located on the sides of storage tank 44 below supply tank 42 results in a very strong, compact assembly having a generally rectangular cross section perimeter maximizing solution volume while minimizing assembly size.

Furthermore, it should be noted that during operation, cleaning solution will be removed from supply tank 42 for application upon the floor and cleaning solution will be deposited within storage tank 44. It can further be appreciated that cleaning solution recovered by portable extractor 10 will be less than the volume of cleaning solution applied. Thus, the total volume and the weight of the cleaning solution will be reduced while portable extractor 10 is utilized. Furthermore, while supply tank 42 has a maximum capacity such as 6 gallons (23 liters), the operator may not fill tank 42 to its maximum capacity for several reasons including the area of the floor to be cleaned. Thus, the weight of the cleaning solution will vary according to the volume thereof. As described hereinbefore, it is very desirable to maintain a constant cleaning pressure on the floor by the cleaning process members including pick-up member 26 and rotary brush 32. It can then be appreciated that the preferred construction of main body assembly 12 including the preferred form of tanks 42 and 44 as shown and described according to the teachings of the present invention maintain generally the same weight load at the pivot axis of hinge members 86 independent of the total volume of cleaning solution in tanks 42 and 44 or the levels of cleaning solution in each of tanks 42 and 44. Specifically, any variation in load caused by solution volume is generally carried solely by wheels 92 rather than wheels 30 and the straddling upper arrangement of supply tank 42 on storage tank 44 allow the weight of the cleaning solution to be centered over wheels 92 at all times independent of the levels in tanks 42 and 44. Thus, the automatic operation of tool assembly 14 between its working and transport mode is not dependent upon the weight or location of cleaning solution in tanks 42 and 44.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Portable extractor for providing cleaning solution to a floor and extracting the cleaning solution from the floor comprising, in combination: a tool assembly having a front end and a rear end; a cleaning solution pick-up member located adjacent the front end of the tool assembly for extracting the cleaning solution from the floor; an applicator for applying cleaning solution to the floor, with the cleaning solution applicator located intermediate the rear end of the tool assembly and the cleaning solution pick-up member; wheels for providing mobility of the tool assembly upon the floor about an axis, with the mobility providing wheels located intermediate the rear end of the tool assembly and the cleaning solution pick-up member; a body assembly including first and second elongated frame members, a cleaning solution supply tank, and an extracted cleaning solution storage tank; with the storage tank being elongated and generally cylindrical in configuration and including a first wall section of a generally semicircular cross section and having first and second free edges and including a second, generally straight wall section extending between the first and second free edges of the first wall section and defining an interior, with the straight wall section having a width; with the supply tank being elongated and generally rectangular in cross sectional configuration and including first and second side walls having a width greater than the width of the first wall section of the storage tank and including first and second end walls, with the second side wall having a recessed portion located intermediate the first and second end walls and having a size and shape complementary to and for receiving the first wall section of the storage tank; with the elongated frame members having top ends and bottom ends; pump means located in the body assembly for drawing cleaning solution from the supply tank and supplying the cleaning solution to the cleaning solution applying means of the tool assembly; vacuum means located in the body assembly for vacuuming extracted cleaning solution from the cleaning solution extracting member of the tool assembly and depositing the extracted cleaning solution into the storage tank; wheels for providing mobility of the body assembly upon the floor about an axis; pivot members located on the bottom ends of the elongated frame members for pivotally mounting the rear end of the tool assembly to the body assembly about an axis generally parallel to and spaced from the axes of mobility providing wheels, with the tool assembly and body assembly being supported on the floor by the mobility providing wheels, and with the axis of the pivot members being located so that the tool assembly pivots about the tool assembly mobility providing wheels into a transport mode of operation such that the cleaning solution pick-up member is spaced from the floor when the tool and body assemblies are advanced along the floor and so that the tool assembly pivots about the tool assembly mobility providing wheels into a working mode of operation such that the cleaning solution pick-up member engages the floor when the tool and body assemblies are retracted along the floor.

2. The portable extractor of claim 1 wherein the elongated frame members have a height and a width; wherein the second side wall of the supply tank is spaced from the second wall section of the storage tank a distance generally equal to the height of the frame members when the first wall section of the storage tank is received in the recessed portion of the supply tank; wherein the first and second end walls of the supply tank are spaced from the first and second free edges of the first wall section of the storage tank a distance generally equal to the width of the elongated frame members, such that the storage and supply tanks can be assembled with the frame members and have a generally rectangular perimeter cross section.

3. The portable extractor of claim 2 wherein the frame members are at an angular orientation of approximately 45 degrees from the floor.

4. The portable extractor of claim 3 further comprising, in combination: a handle of a generally U-shaped configuration and having legs including a right angular bend and having their free ends secured to the upper ends of the elongated frame members.

5. The portable extractor of claim 1 wherein the tool assembly comprises, in combination: a platform secured to an end wall at a corner, with the end wall having a free, top end; with the axis of the pivot members being adjacent to the top end of the end wall; and wherein the portable extractor further comprises, in combination: means for preventing the corner of the platform from engaging the floor when the tool assembly pivots about the tool assembly mobility providing wheels such that the cleaning solution pick-up member is spaced from the floor.

6. The portable extractor of claim 5 wherein the corner engaging preventing means comprises, in combination: an abutment wall extending from the end wall of the platform in a direction away from the front end of the tool assembly; a stop secured to the abutment wall; and means located on the body assembly for abutting with the stop of the tool assembly.

7. The portable extractor of claim 6 wherein the stop of the tool assembly is a bolt having a shank threadably secured in the abutment wall, with the bolt having an enlarged head; and wherein the abutting means of the body assembly includes a removed portion having a shape and size for reciprocal receipt of the shank of the bolt but for preventing the enlarged head of the bolt from passing therethrough.

8. The portable extractor of claim 6 further comprising, in combination: means for limiting the pivotal movement of the tool assembly about the axis of the pivot members when the body assembly is tilted towards the floor raising the tool assembly off the floor.

9. The portable extractor of claim 8 wherein the limiting means is integral and formed with the abutting means of the body assembly, with the abutment wall of the tool assembly abutting the limiting means of the body assembly.

10. The portable extractor of claim 1 further comprising, in combination: means for agitating the floor surface for removing dirt therefrom, with the agitating means located intermediate the cleaning solution pick-up member and the cleaning solution applicator.

11. The portable extractor of claim 10 wherein the agitating means comprises, in combination: a rotary brush mounted to the tool assembly for engaging the floor simultaneously with the cleaning solution pick-up member; and means mounted to the tool assembly for rotating the rotary brush.

12. The portable extractor of claim 1 further comprising, in combination: means for biasing the tool assembly towards its working mode of operation.

13. The portable extractor of claim 12 wherein the biasing means comprises a torsion spring between the tool assembly and the body assembly for urging the tool assembly to pivot about the axis of the pivot members such that the front end of the tool assembly moves away from the body assembly.

14. Apparatus for cleaning a surface comprising, in combination: a tool assembly having a front end and a rear end; means located adjacent the front end of the tool assembly for performing at least one cleaning process to the surface; means for providing mobility of the tool assembly upon the surface, with the mobility providing means located intermediate the rear end of the tool assembly and the cleaning process means; a body assembly having a bottom end; means for providing mobility of the body assembly upon the surface; and means for pivotally mounting the rear end of the tool assembly to the body assembly about an axis generally parallel to and spaced from the mobility providing means, with the axis of the pivotally mounting means being located so that the tool assembly pivots about the tool assembly mobility providing means into a transport mode of operation such that the cleaning process means is spaced from the surface when the tool and body assemblies are moved along the surface in a first direction and so that the tool assembly pivots about the tool assembly mobility providing means into a working mode of operation such that the cleaning process means engages the surface when the tool and body assemblies are moved along the surface opposite the first direction.

15. The cleaning apparatus of claim 14 wherein the cleaning process means comprises, in combination: means located adjacent the front end of the tool assembly for extracting cleaning solution from the surface; and means for applying cleaning solution to the surface, with the cleaning solution applying means located intermediate the rear end of the tool assembly and the cleaning solution extracting means, with the mobility providing means located intermediate the rear end of the tool assembly and the cleaning solution extracting means; wherein the cleaning apparatus further comprises, in combination: a cleaning solution supply tank located in the body assembly; an extracted cleaning solution storage tank located in the body assembly; means located in the body assembly for drawing cleaning solution from the supply tank and supplying the cleaning solution to the cleaning solution applying means of the tool assembly; and means located in the body assembly for vacuuming extracted cleaning solution from the cleaning solution extracting means of the tool assembly and depositing the extracted cleaning solution into the storage tank, with the axis of the pivotally mounting means being located so that the tool assembly pivots about the tool assembly mobility providing means into a transport mode of operation such that the cleaning solution extracting means is spaced from the surface when the tool and body assemblies are advanced along the surface and so that the tool assembly pivots about the tool assembly mobility providing means into a working mode of operation such that the cleaning solution extracting means engages the surface when the tool and body assemblies are retracted along the surface.

16. The cleaning apparatus of claim 15, further comprising in combination: means for agitating the surface for removing dirt therefrom, with the agitating means located intermediate the cleaning solution extracting means and the cleaning solution applying means.

17. The cleaning apparatus of claim 16 wherein the agitating means comprises, in combination: a rotary brush mounted to the tool assembly for engaging the floor simultaneously with the cleaning solution extracting means; and means mounted to the tool assembly for rotating the rotary brush.

18. The cleaning apparatus of claim 15 wherein the storage tank is elongated and generally cylindrical in configuration and includes a first wall section of a generally semicircular cross section and having first and second free edges and includes a second, generally straight wall section extending between the first and second free edges of the first wall section and defining an interior, with the straight wall section having a width; with the supply tank being elongated and generally rectangular in cross sectional configuration and including first and second side walls having a width greater than the width of the first wall section of the storage tank and including first and second end walls, with the second side wall, having a recessed portion located intermediate the first and second end walls and having a size and shape complementary to and for receiving the first wall section of the storage tank.

19. The portable extractor of claim 18 further comprising, in combination: first and second elongated frame members having top ends and bottom ends, with the axis of the pivotally mounting means located at the bottom ends of the elongated frame members; wherein the elongated frame members have a height and a width; wherein the second side wall of the supply tank is spaced from the second wall section of the storage tank a distance generally equal to the height of the frame members when the first wall section of the storage tank is received in the recessed portion of the supply tank; wherein the first and second end walls of the supply tank are spaced from the first and second free edges of the first wall section of the storage tank a distance generally equal to the width of the elongated frame members, such that the storage and supply tanks can be assembled with the frame members and have a generally rectangular perimeter cross section; and wherein the frame members are at an angular orientation of approximately 45 degrees from the floor.

20. The cleaning apparatus of claim 19 further comprising, in combination: a handle of a generally U-shaped configuration and having legs including a right angular bend and having their free ends secured to the upper ends of the elongated frame members.

21. The cleaning apparatus of claim 14 further comprising, in combination: means for preventing the rear end of the tool assembly from engaging the surface when the tool assembly is pivoted into its transport mode of operation.

22. The cleaning apparatus of claim 21 further comprising, in combination: means for limiting the pivotal movement of the tool assembly about the axis of the pivotally mounting means when the body assembly is tilted towards the surface raising the tool assembly off the surface.

23. The cleaning apparatus of claim 21 wherein the tool assembly comprises, in combination: a platform secured to an end wall at a corner, with the end wall having a free, top end; with the axis of the pivotally mounting means being adjacent to the top end of the end wall; and wherein the preventing means comprises, in combination: means for preventing the corner of the platform from engaging the surface when the tool assembly is pivoted into its transport mode.

24. The cleaning apparatus of claim 23 wherein the corner engaging preventing means comprises, in combination: an abutment wall extending from the end wall of the platform in a direction away from the front end of the tool assembly; a stop secured to the abutment wall; and means located on the body assembly for abutting with the stop of the tool assembly.

25. The cleaning apparatus of claim 24 wherein the stop of the tool assembly is a bolt having a shank threadably secured in the abutment wall, with the bolt having an enlarged head; and wherein the abutting means of the body assembly includes a removed portion having a shape and size for reciprocal receipt of the shank of the bolt but for preventing the enlarged head of the bolt from passing therethrough.

26. The cleaning apparatus of claim 25 further comprising, in combination: means for limiting the pivotal movement of the tool assembly about the axis of the pivotally mounting means when the body assembly is tilted towards the surface raising the tool assembly off the surface.

27. The cleaning apparatus of claim 26 wherein the limiting means is integral and formed with the abutting means of the body assembly, with the abutment wall of the tool assembly abutting the limiting means of the body assembly.

28. The cleaning apparatus of claim 14 further comprising, in combination: means for biasing the tool assembly towards its working mode of operation.

29. The cleaning apparatus of claim 28 wherein the biasing means comprises a torsion spring between the tool assembly and the body assembly for urging the tool assembly to pivot about the axis of the pivotally mounting means such that the front end of the tool assembly moves away from the body assembly.

30. The cleaning apparatus of claim 14 wherein the cleaning proceoss means comprises a pick-up member; and wherein the apparatus further comprises, in combination: a storage tank located in the body assembly; and means located in the body assembly for vacuuming extracted material from the pick-up member of the tool assembly and depositing the extracted material into the storage tank.

* * * * *

UNITED STATES PATENT OFFICE

CERTIFICATE OF CORRECTION

Patent No. 4,709,442 Dated December 1, 1987

Inventor(s) William C. Sletten, II

It is certified that error appears in the above-identified patent and that said Letters Patent are hereby corrected as shown below:

Column 8, line 59, cancel "elongated" and substitute therefor --, elongated,--.

Column 11, line 36, cancel ",".

Column 11, line 44, cancel "floor" and substitute therefor --surface--.

Column 11, line 64, cancel "portable extractor" and substitute therefor --cleaning apparatus--.

Column 14, line 2, cancel "proceoss" and substitute therefor --process--.

Signed and Sealed this

Fifth Day of July, 1988

*Attest:*

DONALD J. QUIGG

*Attesting Officer*

*Commissioner of Patents and Trademarks*